United States Patent [19]

Magnin

[11] 4,030,287

[45] June 21, 1977

[54] ARTICULATED BRACELET

[76] Inventor: Roland Magnin, 32, rue des Noirettes, 1227 Carouge, Switzerland

[22] Filed: Jan. 23, 1976

[21] Appl. No.: 651,793

[30] Foreign Application Priority Data

Jan. 27, 1975 Switzerland ..... 936/75

[52] U.S. Cl. ..... 59/85; 59/90

[51] Int. Cl.[2] ..... F16G 15/04

[58] Field of Search ..... 59/80, 82, 78, 84, 90, 59/35, 85, 91

[56] References Cited

UNITED STATES PATENTS

| | | | |
|---|---|---|---|
| 1,684,977 | 9/1928 | Tost | 59/35 |
| 2,246,221 | 6/1941 | Prestinari | 59/80 |

FOREIGN PATENTS OR APPLICATIONS

| | | | |
|---|---|---|---|
| 960,355 | 4/1950 | France | 59/80 |
| 410,495 | 10/1966 | Switzerland | 59/80 |

*Primary Examiner*—C.W. Lanham
*Assistant Examiner*—Gene P. Crosby
*Attorney, Agent, or Firm*—Robert E. Burns; Emmanuel J. Lobato; Bruce L. Adams

[57] ABSTRACT

An articulated bracelet comprises a chain of visible tubular links of oval section, adjacent pairs of which are connected by joining links hookably engaging in rectangular openings in the tubular links. Each adjacent pair of joining links are retained by mutual coaction of complementary hook-like end parts in a hollow element, whereby links can be added or removed by hand.

4 Claims, 4 Drawing Figures

ARTICULATED BRACELET

BACKGROUND OF THE INVENTION

The invention relates to articulated bracelets made up of interconnected elements.

SUMMARY OF THE INVENTION

According to the invention, there is provided a bracelet comprising a chain of visible hollow elements each adjacent pair of which is connected by a joining element hookably engaging in the adjacent hollow elements, each pair of mutually adjacent joining elements being retained by mutual coaction in a hollow element.

BRIEF DESCRIPTION OF THE DRAWINGS

An embodiment of the invention is shown, by way of example, in the accompanying drawings, in which.

DESCRIPTION OF THE PREFERRED EMBODIMENT

Figure 1:
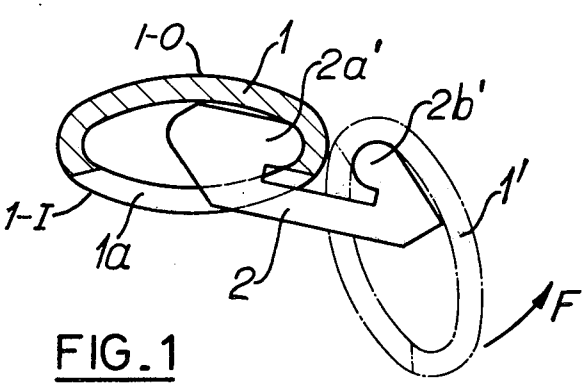
FIGS. 1 to 3 are schematic, partial views of the new bracelet, showing the assembling of successive links, and showing the visible links in cross-section along line A—A of FIG. 4.
Figure 4:
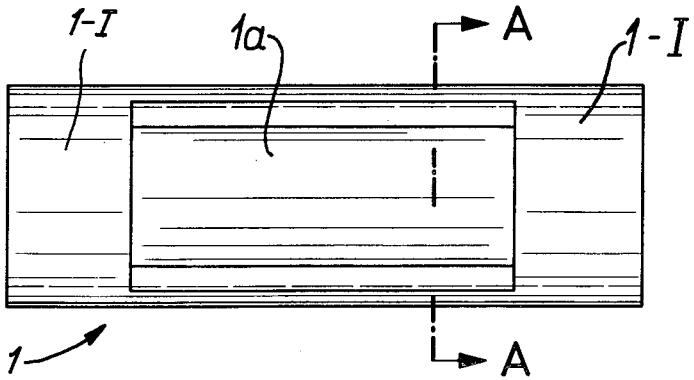
FIG. 4 is a bottom view of one of the visible links, drawn on a slightly smaller scale than FIGS. 1 to 3.

The bracelet shown comprises a chain of outer tubular elements or links, 1' of oval cross-section each having a visibly exposed, outer, flattened face 1-0 and, adjacent each end of the tubular element, inner, flattened face portions 1-I. The inner face is not generally visibly exposed in the normal use of the bracelet, when the bracelet is worn a longitudinally disposed rectangular opening 1*a* is provided between and defined by these inner faces 1-I, as shown in FIGS. 1 and 4, and is, like the faces 1-I, not generally visibly exposed in normal use. Through this opening the ends of two mutually adjacent joining elements or inner links 2, 2' can be introduced into each bracelet link.

Figure 2:
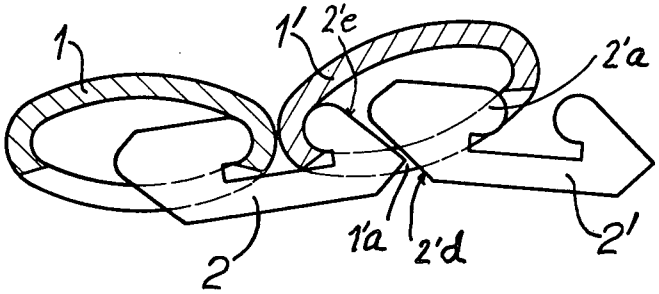

Each joining link 2,2' is in the form of a solid piece having a first hook-like end 2*a* which has an inclined outer plane face 2*d* and a second hook-like end 2*b* having an inclined outer plane face 2*e* parallel to face 2*d*. The face 2*e* terminates, at its end furthest away from the opposite end of the hook, with a projecting edge 2*c*. The hook-like ends 2*a*, 2*b* have facing curved end parts 2*a'*, 2*b'*, the curvature of which is complementary to the inner curvature of the flattened hollow links 1, 1'. The first end 2*a* is thicker than the second end 2*b*, the combined thickness of the mutually adjoining ends, when adjacent links are placed together as shown in FIG. 2, being substantially equal to the width of opening 1*a*. Each joining link has a width substantially equal to the longer edge of rectangular opening 1*a*.

Figure 3:
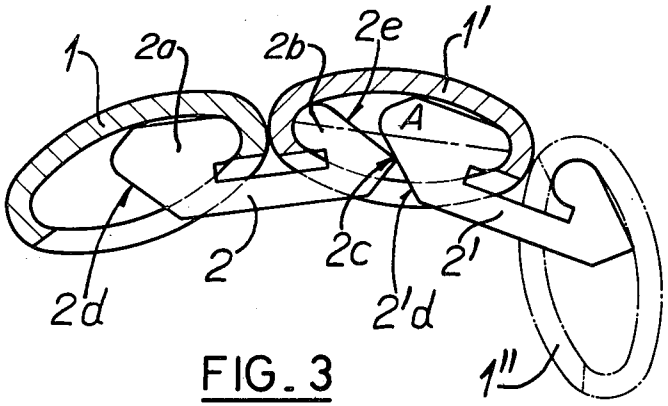

To assemble the bracelet, the end 2*a* of an inner link 2 is introduced, as shown in FIG. 1, in the opening 1*a* of a first an inner link 1. The link 1 is thereupon engaged with the curved part 2' of end 2*a* to place the interior of the oval wall of link 1 into pivotal engagement with the outer extremity of end 2*s*, as shown in FIG. 1. The following hollow link 1' is then added by passing end 2*b* through its opening 1'*a*, and pivoting link 1' in a first, counter-clockwise direction of arrow F so far as the then assembled links allow, thereby relatively widely exposing the remaining part of opening 1'*a* as shown in FIG. 2. The second joining link 2' is then introduced in the opening 1'*a* of link 1', by sliding its face 2'*d* against face 2*e* of the first joining link 2 until its end 2'*a* is entirely inside the hollow link 1'. As soon as the link 1' is then pivoted in the clockwise direction (i.e. opposite to arrow F), the edge 2*c* of link 2 comes to bear against the face 2'*d* of link 2', so that the two joining links 1, 1' are retained by mutual coaction in the hollow link 1', as shown in FIG. 3.

The following hollow link 1'' is then added in the same manner as link 1', and so on, to make up the bracelet.

In normal use, when the bracelet is worn or laid flat it is firmly held together by the mutual coaction of the adjacent pair of joining links. However, if it is desired to shorten the bracelet, this can be easily done by pivoting a hollow link in the manner of link 1' (FIG. 2) and removing corresponding ones of its joining links. In normal use, edge 2*c* of one inner link contacts link surface 2'*d* of an adjacent inner link, which surface is inclined to a major axis A of the respective outer link, as shown in FIG. 3.

Assembly of the bracelet, and lengthening or shortening it, can thus be achieved very simply, by hand and without the need for any tool.

I claim:

1. A bracelet, comprising:

a chain of outer, tubular links of oval cross-section, each outer link having an outer face, normally visible, exposed when the bracelet is worn, and an inner face, defining an opening; and pairs of inner links, each having mutually facing, rounded, terminal hook portions for pivotal action against mutually adjacent rounded inner surfaces of said outer links, each inner link having its terminal hook portions extending into the openings of a pair of mutually adjacent ones of the outer links, to normally interconnect the outer links by the inner links.

2. A bracelet according to claim 1, in which link surfaces of each inner link include a first external plane face, inclined to a major axis of the oval cross section of the respective outer link, and a second external plane face substantially parallel to said first face, said second face terminating in an edge at its end furthest away from the opposite hook portion of the same inner link, so that first and second terminal hook portions of adjacent inner links can be hooked in one of the outer links, and are then retained therein by mutual contact between the edge of one inner link and the first plane face of the other inner link, while the inner links are hidden by the visibly exposed outer faces of the outer links.

3. A bracelet according to claim 1, in which said openings are rectangular, and each pair of inner links has a length of the hook portions extending into the respective opening, said length being substantially equal during assembly to a side length of the opening.

4. A bracelet according to claim 1, in which the inner links are solid elements, interconnecting the tubular outer links.

* * * * *